United States Patent [19]

Skakunov et al.

[11] 4,145,892

[45] Mar. 27, 1979

[54] LIQUID STORAGE RESERVOIR

[75] Inventors: Mikhail G. Skakunov, Moskovskaya oblast; Ivan F. Matsenko, Moscow, both of U.S.S.R.

[73] Assignee: Gosudarstvenny Proektno-Konstruktorsky Institut Po Proektirovaniju Tekhnologii Montazha Legkoi i Pischevoi Promyshlennosti, Moscow, U.S.S.R.

[21] Appl. No.: 820,140

[22] Filed: Jul. 29, 1977

[51] Int. Cl.[2] ..... F17C 7/02

[52] U.S. Cl. ..... 62/45; 114/74 A; 220/901

[58] Field of Search ..... 62/45, 54; 220/901; 114/74 A

[56] References Cited

U.S. PATENT DOCUMENTS

| | | | |
|---|---|---|---|
| 2,386,958 | 10/1945 | Jackson | 62/45 |
| 2,512,308 | 6/1950 | Cooper | 62/45 |
| 2,800,249 | 7/1957 | Beckwith | 62/45 |
| 3,527,379 | 9/1970 | Mair | 62/45 |

*Primary Examiner*—Ronald C. Capossela
*Attorney, Agent, or Firm*—Burgess, Ryan and Wayne

[57] ABSTRACT

A liquid storage reservoir of which the internal space defined by the body, and, the upper and the lower covers, has mounted therein a hollow post interconnecting these covers and having its internal space communicating with the internal space of the reservoir for escape of vapors of the liquid being stored, the open end of the post extending beyond the internal space of the reservoir. The upper and lower covers are hollow and communicate via conduits extending in the body along the generatrix thereof, the open end of the hollow post entering the internal space of one of said covers, the internal space of the other cover communicating with a vessel for collecting condensed vapors of the stored liquid. The disclosed reservoir is particularly suited for storing easily evaporating and volatile liquids, because it practically eliminates their evaporation losses.

4 Claims, 6 Drawing Figures

LIQUID STORAGE RESERVOIR

FIELD OF APPLICATIONS OF THE INVENTION

The invention relates to liquid storage reservoirs.

A liquid storage reservoir constructed in accordance with the present invention is particularly suitable for storing readily evaporating and volatile liquids.

The improvement disclosed in the present invention yields maximum effectiveness in case of thin-wall spherical reservoirs of internal volume in excess of 50 cubical meters.

DISADVANTAGES OF THE PRIOR ART

Known in the art are storage reservoirs for storing volatile liquids. The internal space of the reservoirs of the prior art is defined by a cylindrical body and by covers adjoining this body from above and from below. The lower cover in most cases is integral with the body. A hollow post extending centrally of the reservoir between said covers communicates with the internal space of the reservoir for collecting vapors of the liquid being stored. One end of the hollow post extends beyond the reservoir and communicates with ambient atmosphere, for escape of vapors from the reservoir.

Furthermore, known in the art are reservoirs with refrigerating plants mounted on the upper cover and accommodated in the internal space of the reservoir.

The refrigerating plants to maintain a permanent controlled temperature within the reservoir and thus prevent evaporation of the liquid being stored.

However, when great volumes of liquids are to be stored, reservoirs with refrigerating plants have a bulky and complicated structure, to say nothing of their being costly and consuming large amounts of energy.

OBJECTS AND BRIEF DESCRIPTION OF THE INVENTION

It is an object of the present invention to provide a liquid storage reservoir of a relatively compact and simple structure.

It is another object of the present invention to practically prevent evaporation losses of a liquid being stored.

It is still another object of the present invention to reduce the cost of manufacture of the liquid storage reservoir.

It is a further object of the present invention to reduce energy consumption in operation of the liquid storage reservoir.

With these and other obejects in view, there is herein disclosed a liquid storage reservoir having an internal space defined by a body, an upper cover and a lower cover, this space accommodating therein a hollow post interconnecting these covers, communicating with the internal space of the reservoir for escape of vapors of the liquid being stored and having its open end extending beyond this internal space, in which reservoir, in accordance with the present invention, the upper and lower covers are hollow and communicate via conduits made in the body and extending along the generatrix thereof, the open end of the hollow post projecting into the internal space of one of said covers, the internal space of the other cover communicating with a vessel for collecting condensed vapors of the liquid being stored.

It is preferred that the open end of the hollow post should project into the internal space of the upper cover, with the passages in the body accommodating therein heat exchange means adapted for circulation of a coolant therethrough.

A reservoir of this construction is capable of condensing effectively the vapors of the liquid being stored, notwithstanding the ambient temperature.

It may also be advantageous to have the hollow post accommodating therein a heat exchanger adapted for circulation of a coolant therethrough, the open end of the post projecting into the internal space of the lower cover, the reservoir comprising a system for positive feed of the condensed vapors from the internal space of the lower cover through the conduits in the body into the internal space of the upper cover, communicating via check valves with the internal space of the reservoir, for returning the condensed vapors to the top surface of the liquid being stored.

The above specified structure of the reservoir likewise provides for effective condensation of the vapors of the product being stored within the reservoir and offers a unitary closed system precluding escape of the vapors into the ambient atmosphere, the construction being characterized by compact dimensions of the condensing system and of the system, as a whole.

It may be quite expedient to have the internal space of the hollow post communicating with the internal space of the reservoir via check valves.

The incorporation of the check valves prevents the liquid being stored from entering into the internal space of the post.

BRIEF DESCRIPTION OF THE DRAWINGS

A liquid storage reservoir constructed in accordance with the present invention is structurally simple and practically completely prevents evaporation losses of the stored liquid.

The following is a description of preferred embodiments of the present invention, with reference being had to the accompanying drawings, wherein.

DETAILED DESCRIPTION OF THE DRAWINGS AND EMBODIMENTS

Figure 1:
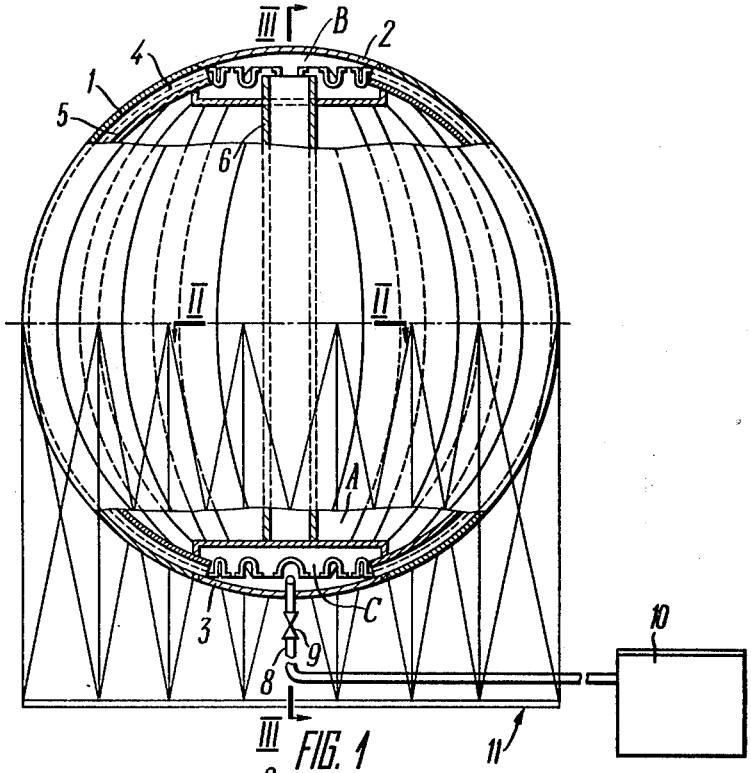
FIG. 1 is a general partly broken away view of a liquid storage reservoir embodying the invention.
Figure 2:
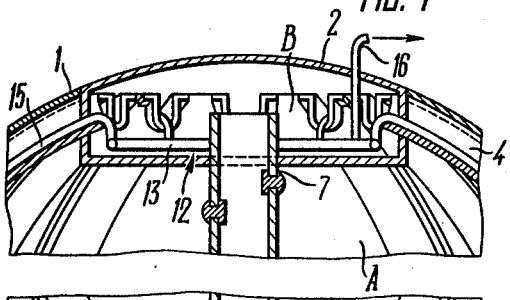
FIG. 2 is a sectional view taken on line II—II of FIG. 1.
Figure 2:
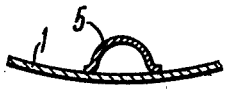

The present invention will be described hereinbelow in connection with its embodiment in a thin-wall reservoir having a generally spherical shape. The reservoir has a body 1 (FIG. 1) with an upper cover 2 adjoining the body 1 from above and the lower cover 3 adjoining it from below. The body 1 and the covers 2 and 3 define therebetween the internal space "A" of the reservoir.

The covers 2 and 3 are hollow, their respective internal spaces "B" and "C" communicating with each other via conduits 4 made within the body 1 and extending along the generatrix of the latter. The conduits 4 in the presently described embodiment are defined by channel-shaped elements 5 fixed on the internal surface of the body and also serving as reinforcement or rigidity ribs of the presently disclosed thin-wall spherical reservoir.

Extending centrally of the internal space "A" of the reservoir, between the covers 2 and 3, is a hollow post 6 which in the structure of the reservoir is the supporting member. The upper portion of the internal space of the hollow post 6 communicates via check valves 7 (FIG. 3) with the internal space "A" of the reservoir, for collecting vapors of the liquid being stored therefrom. The open end of the hollow post 6 projects into the internal space "B" of the upper cover 2.

The internal space "C" of the lower cover 3 is connected via a line 8 and a cut-off valve 9 with a receptacle 10 (FIG. 1) for collecting condensed vapors of the stored liquid, situated outside the reservoir.

The spherical reservoir is supported by a mount 11.

The above described structure of the reservoir is the simplest one. When the temperature drop across the surface of the reservoir is considerable (e.g. when one side of the reservoir is lighted by the sun, while the other is in a shadow), natural condensation of the vapors takes place in the passages 4 of the body of the reservoir.

To intensify the condensation of the vapors of the stored liquid, the reservoir additionally incorporates a heat exchanger 12 (FIG. 3) for circulation of a coolant therethrough, the heat exchanger 12 including annular manifolds 13 and 14 accommodated, respectively, in the spaces "B" and "C" of the upper cover 2 and of the lower cover 3, interconnected by tubes 15 extending through the conduits 4. The annular manifold 14 is connected to a source (not shown) of the coolant which may be cool water or any other known per se coolant suitable for the purpose. The annular manifold 13 is connected with a coolant outlet tube 16.

Mounted in the space "C" is a sensor 17 responsive to the level of the condensed vapors, of which the movable member in the presently described embodiment is adapted to operate the valve 19 closing the line 8.

To provide a closed system for recirculation of condensed vapors of the stored liquid entirely within the reservoir per se, the hollow post 20 (FIG. 4) can be mounted so that its open end should project into the space "C". The hollow post 20 accommodates therein a heat exchanger 21 comprising a coil having one end thereof connected to a source of a coolant, and the other end thereof serving as the coolant outlet one.

To pump the condensed vapors accummulating in the space "C" into the space "B" there is provided a condensate positive feed system 22.

Figure 5:
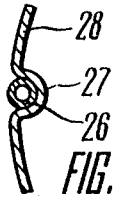
FIG. 5 is a sectional view taken on line V—V of FIG. 4.

Said system includes a pump 23 of which the intake 24 is connected with the space "C", and the discharge 25 is connected to conduits 26 (FIG. 5) which are lengths of tubes extending along recesses 27 provided in the body 28 along the generatrix thereof. In thin-wall spherical reservoirs the recesses 27 increase the self-supporting strength of the reservoir and serve as reinforcement or rigidity ribs.

The upper cover 29 has mounted therein check valves 30 establishing one-way communication between the space "B" of this cover 29 and the space "A" of the reservoir, which at the same time serves as a condensate collector.

Mounted in the internal space "C" of the lower cover 31 is a sensor 32 responsive to the level of the condensed vapors, which has a movable member 33 adapted to actuate a valve 34 and to send a signal for energization of the pump 23.

Figure 6:
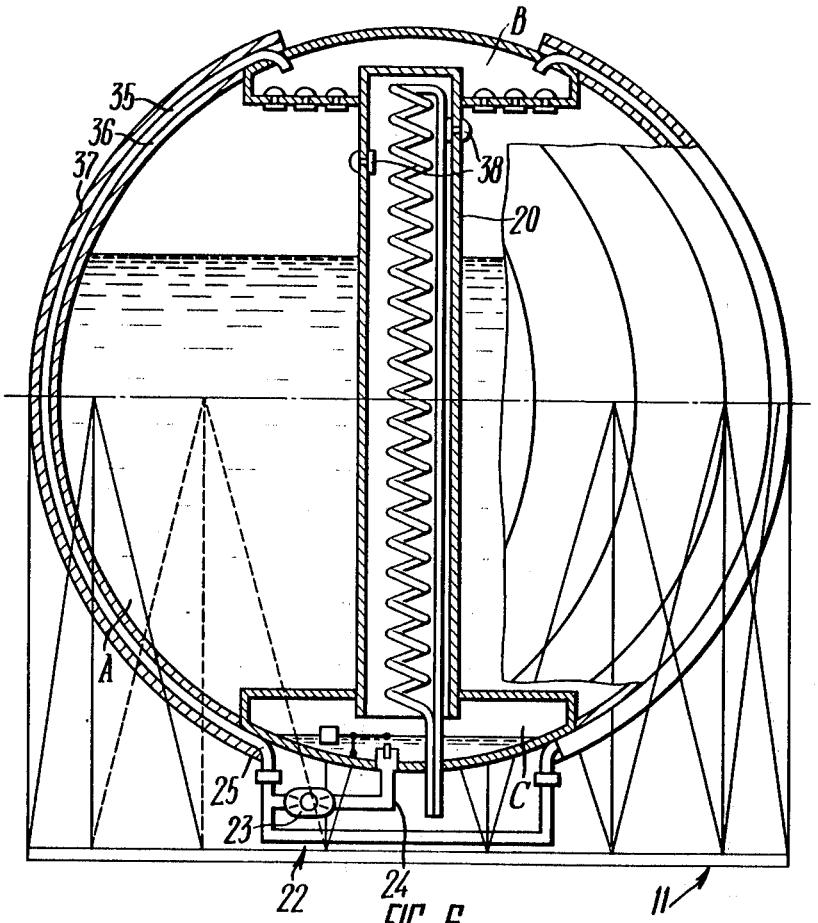
FIG. 6 is a modification of a liquid storage reservoir embodying the invention.

In the reservoir illustrated in FIG. 6 the conduits 35 serve as the condensate discharge line and are defined by the external surface of the body 36 and channel elements 37 secured to this surface along the generatrix of the reservoir.

The last-described arrangement of the conduits increases the useful volume of the internal space "A", is easy in manufacture and offers facilitated operation.

A liquid storage reservoir is operated, as follows.

When the reservoir is used, the liquid stored therein actively evaporates, particularly, if the ambient temperature is relatively high, and so its vapors accumulate in the upper portion of the reservoir.

Figure 3:
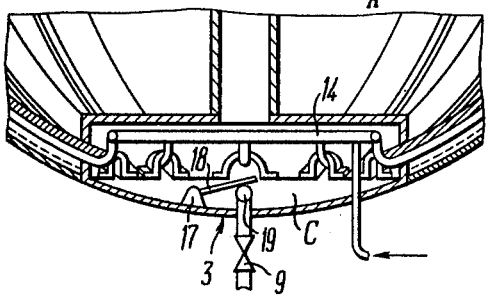
FIG. 3 is a sectional view taken on line III—III of FIG. 1, with the heat exchanger having its components accommodated in the conduits of the body.

In the structural embodiment illustrated in FIGS. 1, 3 the accumulated vapors act upon the check valves 7 of the central post 6. The valves 7 open to pass the vapors to fill up the space of the post 6 and flow therefrom into the internal space "B" of the cover 2 and then from the space "B" the vapors flow into the conduits 4 extending along the generatrix of the body 1 of the reservoir and sealed away from the internal space "A" of the latter.

In the sealed conduits 4 the vapors condense under the conditions of a natural temperature drop. In this case the major portion of the vapors condensing in the lower portion of the reservoir, which is protected from the sun by the supporting structure 11.

Vapors condensing in the passages 4 accumulate in the form of droplets in the space "C" of the lower cover 3, wherefrom, as the space "C" fills to a predetermined level, they flow through the cut-off valve 9, via the line 8 into the collecting receptade 10.

From this receptacle 10 the collected condensate can be returned into the reservoir by any suitable known per se technique.

In applications where the natural temperature drop is insufficient for condensing the vapors, a heat exchanger 12 may be incorporated in the conduits 4 of the reservoir.

In this embodiment the vapors of the liquid are positively condensed in the conduits 4 by the coolant circulated through the tubes 15 of the heat exchanger 12 upon the latter being connected to a source (not shown) of the coolant. When the condensate in a liquid form, positively collected in the internal space "C" of the lower cover 3, rises to a predetermined level, the sensor 17 responds.

The movable element 18 of the sensor 17 actuates the valve 19 to open, and the condensed liquid flows via the line 8 from the space "C" of the cover 3 into the collecting receptacle 10 wherefrom it can be returned into the reservoir in any suitable known manner.

Figure 4:
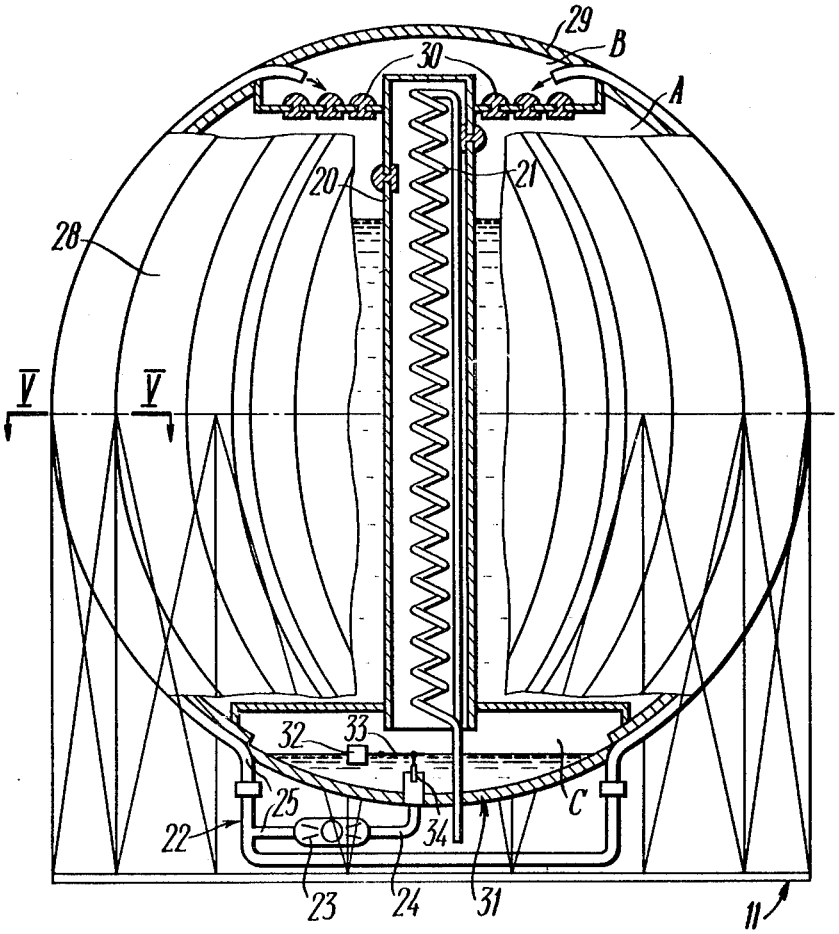
FIG. 4 is a partly longitudinal sectional view of a liquid storage reservoir embodying the invention, with the heat exchanger accommodated in the hollow post.

In the modifications of the reservoir embodying the invention, illustrated in FIGS. 4 and 6, the vapors of the liquid, accumulating in the upper portion of the reservoir and building up the pressure therein, open the check valves 38 establishing one-way communication from the space "A" of the reservoir into the internal space of the post 20, the valves 30 in the cover 29 remaining closed, because they establish one-way communication from the space "B" of the cover 29 into the internal space "A" of the reservoir.

Having opened, the valves 38 of the post 20 pass the vapors of the liquid into the internal space of the latter, where they are condensed by the operation of the heat exchanger 21, and the condensed vapors accumulate in the space "C" of the lower cover 31.

Upon the condensed vapors accumulating in the space "C" to a predetermined level, the level sensor 32 responds, its movable element 33 acting upon the valve 34 and causing energization of the pump 23. The pump draws the condensed vapors directly from the space "C" and pumps them via the discharge line 25 and the conduits 26 into the space "B" of the cover 29, where the condensate, overcoming the vapor pressure within the internal space "A" of the reservoir, falls in droplets upon the surface of the stored liquid, having opened in its way the check valves 30.

Therefore, in the embodiments illustrated in FIGS. 4 and 6, each response of the level sensor 32 results in a period of return of the condensate in the form of droplets into the space "A" of the reservoir, via the conduits integral with the structure of the reservoir per se.

The temperature of the droplets of the condensed vapors being lower than the temperature of the vapor above the surface of the liquid, this cool droplets bring about additional condensation of the vapors, prior to their admittance into the internal space of the support post 20, the additionally condensed vapors thus returning into the liquid phase.

The abovedescribed modifications offer, therefore, the most efficient use of the heat exchanger, with the minimum consumption of the coolant, and within a compact overall structure.

All the abovedescribed embodiments provide for an economical, space-saving and structurally simple system of storing large volumes of readily evaporable and volatile liquids.

The system is that of a closed storage cycle, in accordance with which evolvement of vapors of the liquid in the storage reservoir is tolerated, the vapors being subsequently completely condensed either naturally or forcibly, and the condensate being returned into the main volume of the liquid being stored.

The process of forced or positive condensation renders the operation particularly efficient, characterized as it is by low energy consumption.

A particular feature of the structural embodiments of the present invention, described hereinabove, is that the system in enclosed within a thin-wall reservoir having a spherical shape and incorporating reinforcing and rigidity enhancing members.

The latter are hollow and are interconnected in a specified sequence, to define a closed-cycle storage system, the members additionally incorporating heat exchange means to provide for forced condensation.

Whatever the embodiment, the presently disclosed reservoir is easy in transportation, being as it is an integral structure.

What is claimed is:

1. A liquid storage reservoir comprising a housing, oppositely disposed upper and lower lids adjacent to the top and bottom of said housing respectively, a space within said reservoir being formed by said housing and said lids, cavities formed in said lids, said housing comprising a plurality of peripheral shell segments with reinforcing channels and extending along said shells from the top to the bottom of said housing, said channels connecting said cavities of said lids with each other, a hollow bearing post disposed in said housing between said lids, said bearing post being provided with openings communicating the interior of said post with said space of said reservoir for removing from said space of said reservoir, vapors of the liquid to be stored, said hollow bearing post having an open end extending to the cavity of one of said lids, heat exchangers, means for providing forced circulation of a cooling agent through said heat exchangers, said means being disposed in said reservoir and cooperating with said heat exchangers for condensing the vapors of the liquid to be stored, and means for supplying the condensed vapors to the cavity of said hollow bearing post.

2. A reservoir as defined in claim 1, wherein said open end of said hollow bearing post extends to the cavity of the upper lid, and said heat exchanger has a circulation path of a cooling agent including said channels of said housing.

3. A reservoir as defined in claim 1, wherein said open end of said hollow bearing post extends to the cavity of the lower lid, and said heat exchanger has a circulation path of a cooling agent traversing the cavity of said post, further comprising check valves installed in a wall of the upper lid of said reservoir and for returning the condensate to the space within said reservoir.

4. A reservoir as defined in claim 1, wherein said cavity of said hollow bearing post communicates with said space of said reservoir through return valves installed in said openings of said hollow bearing post.

* * * * *

UNITED STATES PATENT OFFICE
CERTIFICATE OF CORRECTION

Patent No. 4,145,892 Dated March 27, 1979

Inventor(s) Mikhail Grigorievich Skakunov, et al

It is certified that error appears in the above-identified patent and that said Letters Patent are hereby corrected as shown below:

Column 1, line 30: cancel "to".

line 51: change "obejects" to --objects--.

Column 5, line 20: change "this" to --these--.

Signed and Sealed this

*Eleventh* Day of *September 1979*

[SEAL]

*Attest:*

*Attesting Officer*

LUTRELLE F. PARKER

*Acting Commissioner of Patents and Trademarks*